US008974252B1

(12) United States Patent
Yang

(10) Patent No.: US 8,974,252 B1
(45) Date of Patent: Mar. 10, 2015

(54) ELECTRICAL CONNECTOR

(71) Applicant: Cheng Uei Precision Industry Co., Ltd., New Taipei (TW)

(72) Inventor: Chih Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 30 days.

(21) Appl. No.: 14/018,383

(22) Filed: Sep. 4, 2013

(51) Int. Cl.
*H01R 24/00* (2011.01)
*H01R 24/60* (2011.01)

(52) U.S. Cl.
CPC ..... *H01R 24/60* (2013.01)
USPC ..... 439/676

(58) Field of Classification Search
USPC ..... 439/676, 83, 607, 607.41, 607.47, 439/607.48, 607.5, 607.51, 607.55–607.58, 439/607.35, 607.54, 353, 903
See application file for complete search history.

(56) References Cited

U.S. PATENT DOCUMENTS

| | | | | |
|---|---|---|---|---|
| 2007/0141888 | A1* | 6/2007 | Toda et al. | 439/353 |
| 2008/0153353 | A1* | 6/2008 | Hu et al. | 439/610 |
| 2010/0015858 | A1* | 1/2010 | Gerber et al. | 439/676 |
| 2013/0178100 | A1* | 7/2013 | Nagata et al. | 439/607.35 |

* cited by examiner

*Primary Examiner* — Edwin A. Leon
(74) *Attorney, Agent, or Firm* — Cheng-Ju Chiang

(57) ABSTRACT

An electrical connector includes an insulating housing, a plurality of first terminals each having a first elastic portion, a plurality of second terminals each having a second elastic portion, and a shielding shell enclosing the insulating housing. The insulating housing has a top wall, a bottom wall, a rear wall and two side walls which together surround an inserting chamber thereamong. The top wall and the bottom wall respectively define a plurality of first terminal grooves and second terminal grooves which are opened symmetrically about the inserting chamber and communicate with the inserting chamber. The first and second terminals are respectively inserted frontward in the first and second terminal grooves with the first elastic portions and the second elastic portions face-to-face projecting into the inserting chamber and being symmetrical in structure and arrangement about the inserting chamber.

11 Claims, 4 Drawing Sheets

ELECTRICAL CONNECTOR

BACKGROUND OF THE INVENTION

1. Field of the Invention

The present invention relates to a connector, and more particularly to an electrical connector.

2. The Related Art

Nowadays, electrical connectors are widely used in electronic products to realize signal transmission between the electronic products and corresponding peripheral equipments thereof. In order to meet market requirements, the electrical connectors are being at the period of mass production. With the rapid development of electronic technology, the electrical connector is required to give consideration to both high speed information transmission rate and miniaturization structure. However, the electrical connector is often mated with a mating connector in a single direction for insertion. As a result, users need to recognize positive and negative directions of the electrical connector firstly before using the electronic product. It is inconvenient for the users.

SUMMARY OF THE INVENTION

Accordingly, an object of the present invention is to provide an electrical connector. The electrical connector includes an insulating housing, a plurality of terminals and a shielding shell. The insulating housing has a top wall, a bottom wall, a rear wall and two side walls which together surround an inserting chamber thereamong. The top wall and the bottom wall respectively define a plurality of first terminal grooves and second terminal grooves which are opened symmetrically about the inserting chamber and communicate with the inserting chamber. The first terminal grooves and the second terminal grooves are arranged at regular intervals along transverse directions of the top wall and the bottom wall respectively and each extends along a longitudinal direction to further penetrate rearward through the rear wall of the insulating housing. The terminals include a plurality of first terminals and a plurality of second terminals. The first terminals each has a first fastening strip, a first elastic portion and a first soldering portion which are connected with two opposite ends of the first fastening strip. The second terminals each has a second fastening strip, a second elastic portion and a second soldering portion which are connected with two opposite ends of the second fastening strip. The first and second terminals are respectively inserted frontward in the first and second terminal grooves of the insulating housing. The first fastening strips of the first terminals are fixed in the first terminal grooves, the first elastic portions project downward into the inserting chamber, and the first soldering portions have distal ends thereof project rearward behind the rear wall. The second fastening strips of the second terminals are fixed in the second terminal grooves, the second elastic portions project upward into the inserting chamber and are symmetrical with the first elastic portions in structure and arrangement about the inserting chamber, and the second soldering portions have distal ends thereof project downward under the rear wall. The shielding shell encloses the insulating housing.

As described above, the first terminals and the second terminals of the electrical connector of the embodiment of the present invention are assembled in the insulating housing with the first elastic portions and the second elastic portions being symmetrical in structure and arrangement about the inserting chamber. Therefore, users don't need to recognize positive and negative directions of the electrical connector specially when using the electrical connector. It improves the convenience for the users greatly.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
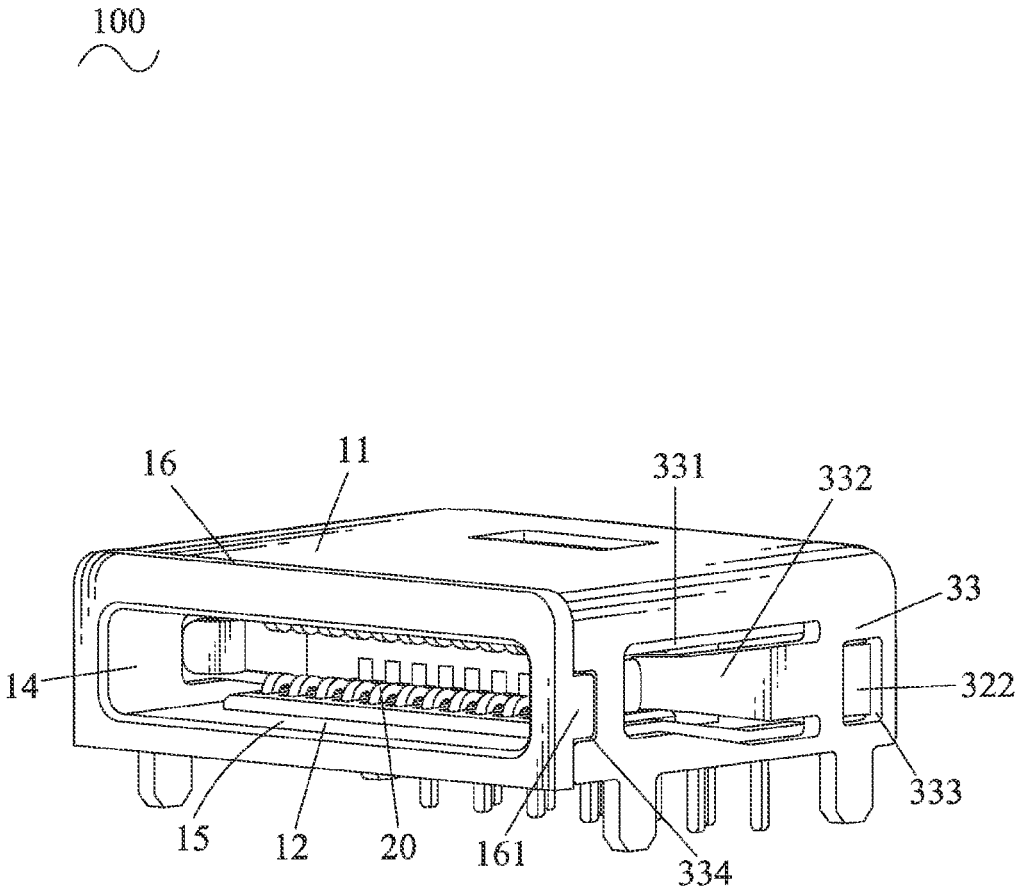
FIG. 1 is an assembled, perspective view of an electrical connector in accordance with an embodiment of the present invention.

Referring to the drawings in greater detail, and first to FIG. 1, an embodiment of the present invention is embodied in an electrical connector 100. The electrical connector 100 includes an insulating housing 10, a plurality of terminals 20 and a shielding shell 30.

Figure 2:
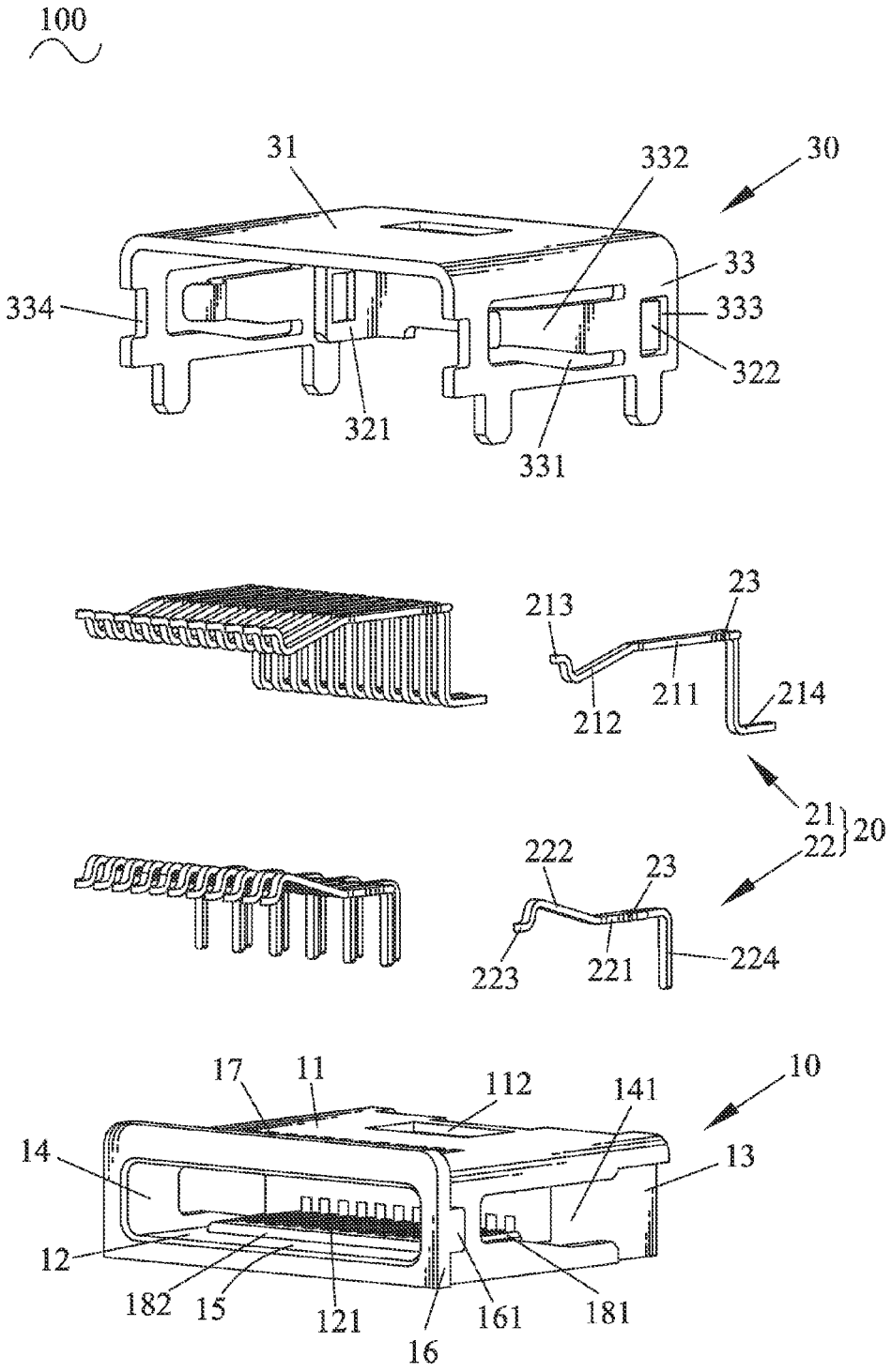
FIG. 2 is an exploded, perspective view of the electrical connector shown in FIG. 1.
Figure 3:
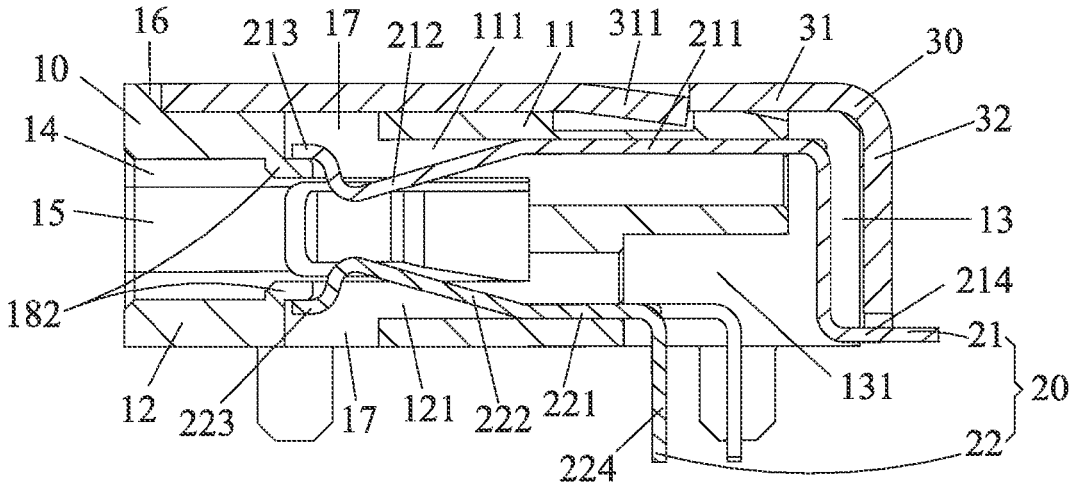
FIG. 3 is a cross-sectional view of the electrical connector shown in FIG. 1.
Figure 4:
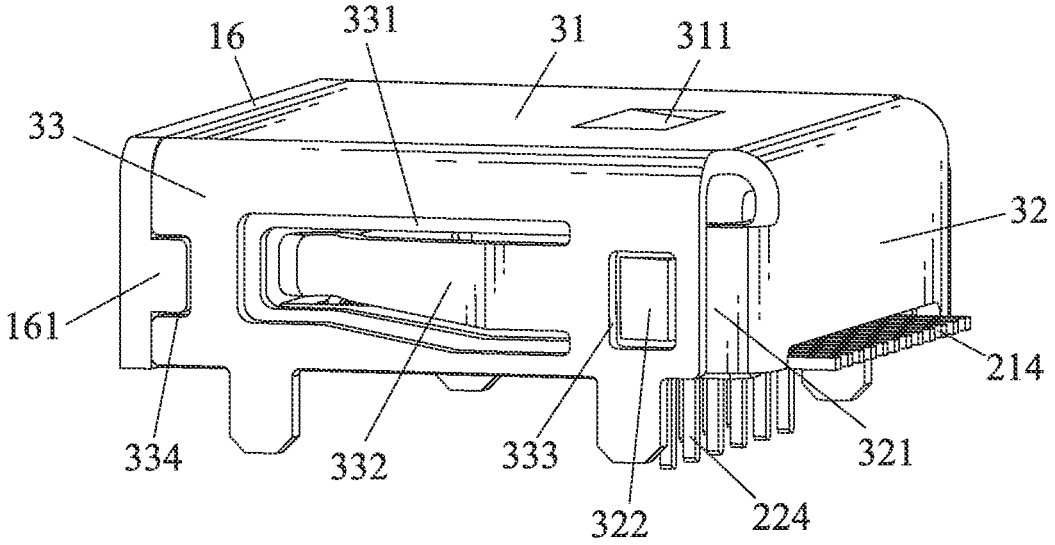
FIG. 4 is another assembled, perspective view of the electrical connector shown in FIG. 1.

With reference to FIG. 2, FIG. 3 and FIG. 4, the insulating housing 10 has a top wall 11, a bottom wall 12, a rear wall 13 and two side walls 14 which together surround an inserting chamber 15 thereamong. The top wall 11 and the bottom wall 12 respectively define a plurality of first terminal grooves 111 and second terminal grooves 121 which are opened symmetrically about the inserting chamber 15 and communicate with the inserting chamber 15. The first terminal grooves 111 and the second terminal grooves 121 are arranged at regular intervals along transverse directions of the top wall 11 and the bottom wall 12 respectively and each extends along a longitudinal direction to further penetrate rearward through the rear wall 13 of the insulating housing 10. A rear middle of a top face of the top wall 11 is concaved downward to from a recess 112. Front ends of the top wall 11 and the side walls 14 protrude outward to form a blocking rib 16 of inverted-U shape of which two vertical parts protrude rearward to form a pair of lumps 161 at substantial middles thereof. Front ends of the first terminal grooves 111 and the second terminal grooves 121 are vertically spread through the top wall 11 and the bottom wall 12 respectively to form a plurality of slots 17. Two blocking eaves 181 are protruded on a bottom side of the top wall 11 and a top side of the bottom wall 12 and transversely over the front ends of the first terminal grooves 111 and the second terminal grooves 121, respectively. The bottom side of the top wall 11 and the top side of the bottom wall 12 further protrude towards the inserting chamber 15 to form a plurality of partitions 182 arranged alternately with the first terminal grooves 111 and the second terminal grooves 121 respectively and each extending longitudinally to connect between the corresponding blocking eave 181 and a front side of the rear wall 13. A rear face of the rear wall 13 is concaved forward to form an L-shaped receiving cavity 131 penetrating through a bottom face of the rear wall 13 and communicating with rear ends of the first terminal grooves 111 and the second terminal grooves 121. Two opposite outsides of the side walls 14 of the insulating housing 10 are concaved inward through the side walls 14 to form a pair of through grooves 141 with front ends thereof communicating with the inserting chamber 15 and rear ends thereof being freely opened.

The terminals 20 include a plurality of first terminals 21 and a plurality of second terminals 22. The first terminals 21 each has a first fastening strip 211, a first elastic portion 212 and a first soldering portion 214 which are connected with two opposite ends of the first fastening strip 211. The first elastic portion 212 is meandered frontward from a front end of the first fastening strip 211 to substantially show a V-shape and a front end of the first elastic portion 212 of the first terminal 21 extends forward to form a first blocking portion 213. The first soldering portion 214 is formed by a rear end of the first fastening strip 211 extending downward and then being bent rearward. The second terminals 22 each has a second fastening strip 221, a second elastic portion 222 and a second soldering portion 224 which are connected with two opposite ends of the second fastening strip 221. The second elastic portion 222 is meandered frontward from a front end of the second fastening strip 221 to substantially show an inverted-V shape and a front end of the second elastic portion 222 of the second terminal 22 extends forward to form a second blocking portion 223. The second soldering portion 224 is bent downward from a rear end of the second fastening strip 221. Two opposite side edges of each rear end of the first fastening strip 211 of the first terminal 21 and the second fastening strip 221 of the second terminal 22 protrude sideward to form a pair of barbs 23.

The shielding shell 30 has a top plate 31, a rear plate 32 and two side plates 33 which are bent and extend downward from rear and side edges of the top plate 31. A rear middle of the top plate 31 is die-cut downward to form an inclined buckling portion 311. The side plates 33 of the shielding shell 30 are opened with a pair of openings 331 corresponding to the through grooves 141 of the insulating housing 10. A rear edge of each opening 331 extends frontward and is inclined inward to form an elastic arm 332 with a distal end thereof being further arched inward. The elastic arms 332 are gradually narrowed along the extend direction thereof. A rear of each side plate 33 is opened with a locking hole 333 located behind the corresponding opening 331. A front edge of each side plate 33 of the shielding shell 30 is concaved rearward to form a notch 334 corresponding to the lump 161 of the insulating housing 10. Two opposite side edges of the rear plate 32 are bent and extend forward to form a pair of locking slices 321 of which each is punched outward to form a locking wedge 322 corresponding to the locking hole 333. The locking slices 321 are against inner sides of the rears of the side plates 33 and the locking wedges 322 are buckled in the locking holes 333.

Referring to FIG. 1, FIG. 2, FIG. 3 and FIG. 4, in assembly, the first and second terminals 21, 22 are respectively inserted frontward in the first and second terminal grooves 111, 121 of the insulating housing 10 to be arranged in two rows in vertical direction. The first fastening strips 211 of the first terminals 21 are fixed in the first terminal grooves 111 and the barbs 23 of each first fastening strip 211 resist against inner sidewalls of the first terminal groove 111 to secure the first terminal 21 in the first terminal groove 111. The first elastic portions 212 project downward into the inserting chamber 15, and the first blocking portions 213 elastically resist against a top side of the blocking eave 181 and are movable in the corresponding slots 17 in vertical direction. The first soldering portions 214 are partially received in the receiving cavity 131 and have distal ends thereof project rearward behind the rear wall 13. The second fastening strips 221 of the second terminals 22 are fixed in the second terminal grooves 121 and the barbs 23 of each second fastening strip 221 resist against inner sidewalls of the second terminal groove 121 to secure the second terminal 22 in the second terminal groove 121. The second elastic portions 222 project upward into the inserting chamber 15 and are symmetrical with the first elastic portions 212 in structure and arrangement about the inserting chamber 15. The second blocking portions 223 elastically resist against a bottom side of the blocking eave 181 and are movable in the corresponding slots 17 in vertical direction. The second soldering portions 224 are partially received in the receiving cavity 131 and have distal ends thereof project downward under the rear wall 13.

The shielding shell 30 is assembled forward to the insulating housing 10 until front edges of the top plate 31 and the side plates 33 are blocked against the blocking rib 16 and the lumps 161 are held in the notches 334 of the side plates 33. The buckling portion 311 of the shielding shell 30 is buckled in the recess 112 of the insulating housing 10. The elastic arms 332 of the side plates 33 of the shielding shell 30 are held in the through grooves 141 of the side walls 14 of the insulating housing 10 and the distal ends of the elastic arms 332 elastically project face-to-face into the inserting chamber 15. In this embodiment, the top edges of the locking slices 321 of the shielding shell 30 are spaced from a bottom side of the top plate 31. The locking slices 321 are held in the rear ends of the through grooves 141 of the insulating housing 10, and top rear ends of the side walls 14 of the insulating housing 10 are clamped between the top edges of the locking slices 321 and the bottom side of the top plate 31.

As described above, the first terminals 21 and the second terminals 22 of the electrical connector 100 of the embodiment of the present invention are assembled in the insulating housing 10 with the first elastic portions 212 and the second elastic portions 222 being symmetrical in structure and arrangement about the inserting chamber 15. Therefore, users don't need to recognize positive and negative directions of the electrical connector 100 specially when using the electrical connector 100. It improves the convenience for the users greatly.

What is claimed is:

1. An electrical connector, comprising:

an insulating housing having a top wall, a bottom wall, a rear wall and two side walls which together surround an inserting chamber thereamong, the top wall and the bottom wall respectively defining a plurality of first terminal grooves and second terminal grooves which are opened symmetrically about the inserting chamber and communicate with the inserting chamber, the first terminal grooves and the second terminal grooves being arranged at regular intervals along transverse directions of the top wall and the bottom wall respectively and each extending along a longitudinal direction to further penetrate rearward through the rear wall of the insulating housing;

a plurality of terminals including a plurality of first terminals and a plurality of second terminals, the first terminals each having a first fastening strip, a first elastic portion and a first soldering portion which are connected with two opposite ends of the first fastening strip, the second terminals each having a second fastening strip, a second elastic portion and a second soldering portion which are connected with two opposite ends of the second fastening strip; and a shielding shell enclosing the insulating housing;

wherein the first and second terminals are respectively inserted frontward in the first and second terminal grooves of the insulating housing to be arranged in two rows in vertical direction, the first fastening strips of the first terminals are fixed in the first terminal grooves, the first elastic portions project downward into the inserting chamber, the first soldering portions have distal ends thereof project rearward behind the rear wall, the second fastening strips of the second terminals are fixed in the second terminal grooves, the second elastic portions project upward into the inserting chamber and are symmetrical with the first elastic portions in structure and arrangement about the inserting chamber, the second soldering portions have distal ends thereof project downward under the rear wall.

2. The electrical connector as claimed in claim 1, wherein a rear face of the rear wall is concaved forward to form an L-shaped receiving cavity penetrating through a bottom face of the rear wall and communicating with rear ends of the first terminal grooves and the second terminal grooves, the first soldering portion is formed by a rear end of the first fastening strip extending downward and then being bent rearward, the second soldering portion is bent downward from a rear end of the second fastening strip, the first and second soldering portions are partially received in the receiving cavity.

3. The electrical connector as claimed in claim 1, wherein two opposite side edges of each rear end of the first fastening strip of the first terminal and the second fastening strip of the second terminal protrude sideward to form a pair of barbs, the barbs of the first fastening strip and the second fastening strip resist against inner sidewalls of the first terminal groove and the second terminal groove respectively.

4. The electrical connector as claimed in claim 1, wherein two blocking eaves are protruded on a bottom side of the top wall and a top side of the bottom wall and transversely over front ends of the first terminal grooves and the second terminal grooves, respectively, the bottom side of the top wall and the top side of the bottom wall further protrude towards the inserting chamber to form a plurality of partitions arranged alternately with the first terminal grooves and the second terminal grooves respectively and each extending longitudinally to connect between the corresponding blocking eave and a front side of the rear wall, a front end of the first elastic portion of the first terminal extends forward to form a first blocking portion, a front end of the second elastic portion of the second terminal extends forward to form a second blocking portion, the first blocking portions and the second blocking portions elastically resist against top and bottom sides of the blocking eaves respectively.

5. The electrical connector as claimed in claim 4, wherein the front ends of the first terminal grooves and the second terminal grooves are vertically spread through the top wall and the bottom wall respectively to form a plurality of slots, the first blocking portions and the second blocking portions are movable in the corresponding slots in vertical direction.

6. The electrical connector as claimed in claim 1, wherein the shielding shell has a top plate, a rear plate and two side plates which are bent and extend downward from rear and side edges of the top plate, a rear of each side plate is opened with a locking hole, two opposite side edges of the rear plate are bent and extend forward to form a pair of locking slices of which each is punched outward to form a locking wedge corresponding to the locking hole, the locking slices are against inner sides of the rears of the side plates and the locking wedges are buckled in the locking holes.

7. The electrical connector as claimed in claim 6, wherein front ends of the top wall and the side walls protrude outward to form a blocking rib of inverted-U shape of which two vertical parts protrude rearward to form a pair of lumps at substantial middles thereof, a front edge of each side plate of the shielding shell is concaved rearward to form a notch corresponding to the lump of the insulating housing, the shielding shell is assembled forward to the insulating housing until front edges of the top plate and the side plates are blocked against the blocking rib and the lumps are held in the notches of the side plates.

8. The electrical connector as claimed in claim 6, wherein two opposite outsides of the side walls of the insulating housing are concaved inward through the side walls to form a pair of through grooves with front ends thereof communicating with the inserting chamber and rear ends thereof being freely opened, the side plates of the shielding shell are opened with a pair of openings corresponding to the through grooves of the insulating housing and located in front of the locking holes, a rear edge of each opening extends frontward and is inclined inward to form an elastic arm with a distal end thereof being further arched inward, the elastic arms of the side plates of the shielding shell are held in the through grooves of the side walls of the insulating housing and the distal ends of the elastic arms elastically project face-to-face into the inserting chamber.

9. The electrical connector as claimed in claim 8, wherein the elastic arms are gradually narrowed along the extend direction thereof.

10. The electrical connector as claimed in claim 8, wherein top edges of the locking slices of the shielding shell are spaced from a bottom side of the top plate, the locking slices are held in the rear ends of the through grooves of the insulating housing, and top rear ends of the side walls of the insulating housing are clamped between the top edges of the locking slices and the bottom side of the top plate.

11. The electrical connector as claimed in claim 6, wherein a rear middle of a top face of the top wall is concaved downward to from a recess, a rear middle of the top plate is die-cut downward to form an inclined buckling portion, the buckling portion of the shielding shell is buckled in the recess of the insulating housing.

* * * * *